United States Patent [19]

Braddon

[11] Patent Number: 4,856,393

[45] Date of Patent: Aug. 15, 1989

[54] METHOD FOR DIE CUTTING PLASTIC FOAM

[76] Inventor: George B. Braddon, 26 Maple Ave., Holcomb, N.Y. 14469

[21] Appl. No.: 60,981

[22] Filed: Jun. 10, 1987

Related U.S. Application Data

[62] Division of Ser. No. 800,732, Nov. 22, 1985, abandoned.

[51] Int. Cl.[4] ..... B26F 1/40

[52] U.S. Cl. ..... 83/50; 83/55; 83/84; 83/85; 83/138; 83/167; 83/556; 83/685

[58] Field of Search ..... 83/50, 55, 96, 97, 128, 83/138, 148, 150, 142, 567, 569, 556, 685, 167, 84, 85

[56] References Cited

U.S. PATENT DOCUMENTS

| | | | |
|---|---|---|---|
| 928,256 | 7/1909 | Grissom | 83/138 |
| 1,941,016 | 12/1933 | Mayle | 83/128 |
| 3,150,550 | 9/1964 | Berlin et al. | 83/685 |
| 3,167,985 | 2/1965 | Madsen | 83/139 |
| 3,762,258 | 10/1973 | Bender | 83/139 |
| 3,850,064 | 11/1974 | Dwyer | 83/124 |
| 4,441,395 | 4/1984 | McRoskey | 83/862 |
| 4,499,802 | 2/1985 | Simpson | 83/117 |
| 4,509,396 | 4/1985 | Schall et al. | 83/126 |
| 4,526,074 | 7/1985 | Johnson | 83/97 |

FOREIGN PATENT DOCUMENTS

| | | | |
|---|---|---|---|
| 2345513 | 10/1974 | Fed. Rep. of Germany | 83/139 |

*Primary Examiner*—Frank T. Yost
*Assistant Examiner*—Hien H. Phan
*Attorney, Agent, or Firm*—James E. Bradley

[57] ABSTRACT

A die cutter for cutting a product from a sheet of material. The die cutter has a rule die blade, which defines the shape of the product. The die blade is held by a die holder, which has an opening corresponding to the die blade, so that the cut product can pass through the die holder. A platen is mounted for relative movement toward and away from the die holder, and has a groove corresponding to the die blade. The die blade thus does not contact the platen at any time. The platen also has passages for the removal of chaff. A resilient stripper plate is mounted on the die holder, adjacent to the die blade, for stripping the material away from the die blade.

3 Claims, 3 Drawing Sheets

METHOD FOR DIE CUTTING PLASTIC FOAM

This application is a division of Ser. No. 800,732, filed 11/22/85, now abandoned.

BACKGROUND OF THE INVENTION

1. Field of the Invention

This invention relates in general to a die cutter for cutting a product from a sheet of material.

2. Description of the Prior Art

Die cutters generally have a rule die blade, held by a die holder, and a platen. As the die holder and the platen are moved together, with the sheet of material between the rule die blade cuts a predetermined shape from the sheet of material. Various types of stripping devices have been used to strip the product and the scrap from the die and the platen after the cutting process. These stripping devices have usually been an elastic member mounted on the die holder or on the platen, adjacent to the rule die blade. The rubber stripper is compressed during the cutting operation, and then when the die holder and the platen are moved apart, the rubber stripper decompresses to push the sheet material away from the die holder or the platen.

The cut product must then be separated from the scrap skeleton. In certain hole punching devices, the scrap hole is removed from the product through a hole in the cylindrical, hollow punch.

SUMMARY OF THE INVENTION

The die cutter of the invention has a rule die blade, which is shaped in the outline of the desired product. A die holder holds the rule die blade, and has an opening corresponding to the rule die blade. Therefore, as the product is cut, the cut product can pass through the die holder.

The die cutter also has a platen, which is mounted for relative movement toward and away from the die holder. The platen has a groove corresponding to the rule die blade, so that the rule die blade does not contact the platen at any time.

A resilient stripper plate is mounted on the die holder, adjacent to the rule die blade. The stripper plate strips the scrap material away from the rule die blade after each cutting operation.

DESCRIPTION OF THE PREFERRED EMBODIMENT

Figure 1:
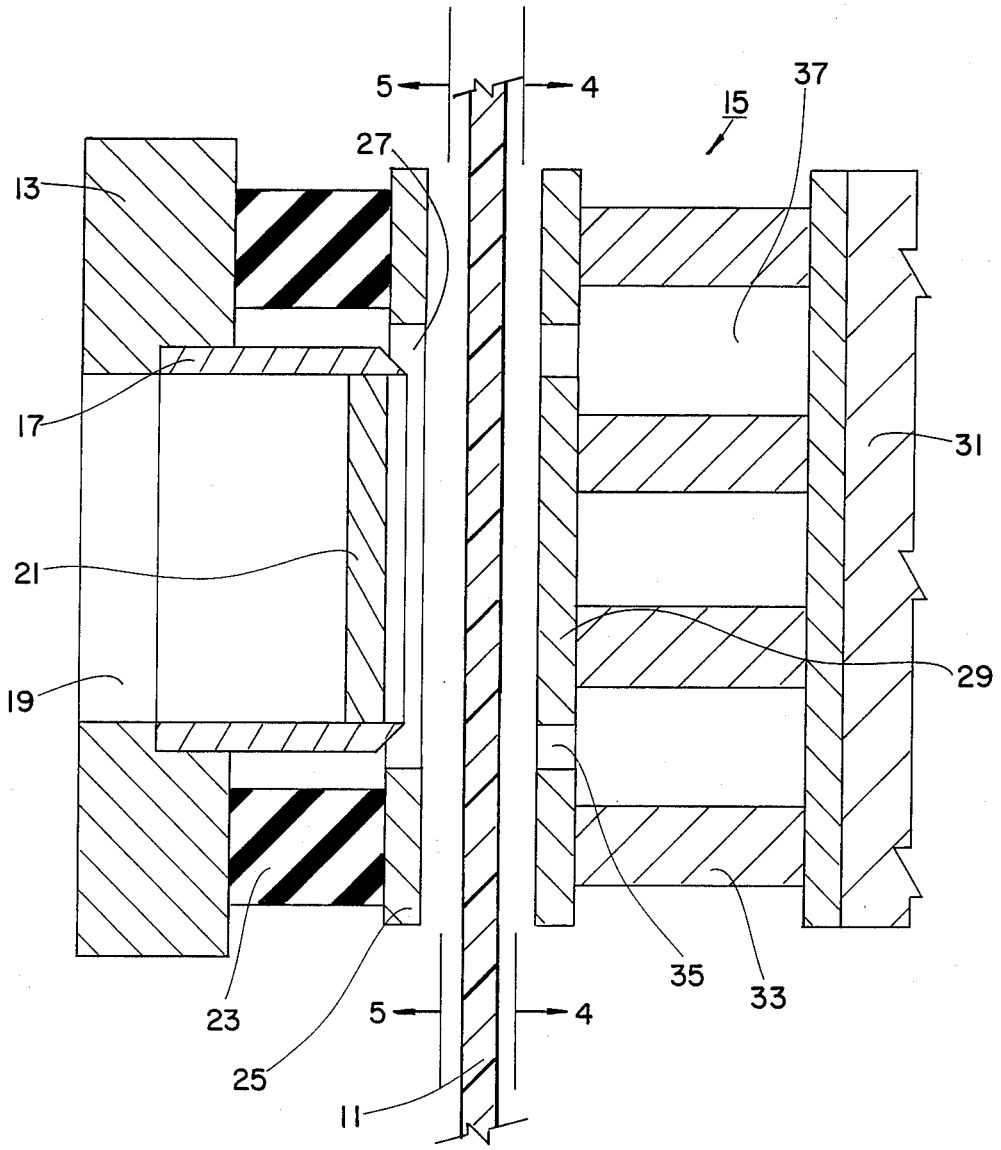
FIG. 1 is a cross-sectional view of the die cutter of the invention.
Figure 5:
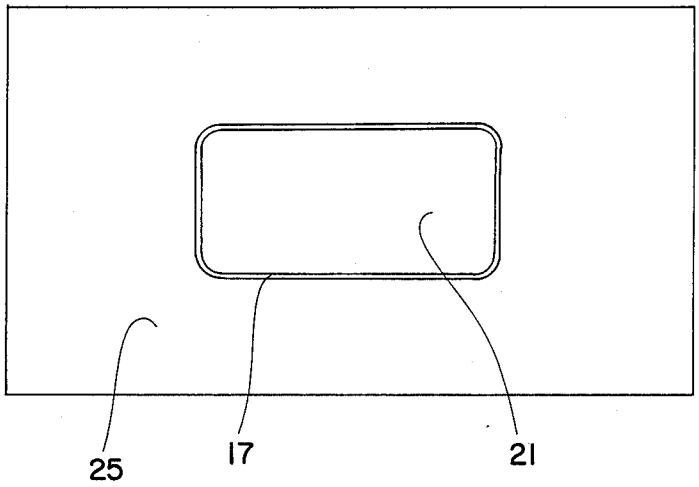
FIG. 5 is a front view of the die holder.

FIG. 1 shows the die cutter prior to the cutting operation. A sheet of material 11 is inserted into the die cutter, between a die holder 13 and a platen 15. The die holder 13 holds a rule die blade 17, which is normally a serrated blade with a single or a double edge. As seen in FIG. 5, the rule die 17 is made in the shape of the product which is to be cut from the sheet of material 11. The rule die 17 and the die holder 13 has passageway 19, so that previously cut pieces 21 can pass through the rule die 17 and the die holder 13.

The die holder 13 also holds a spring 23 and a metal face 25. The spring 23 may be an elastic material, such as rubber, or the spring may be mechanical. The metal face 25 has an opening 27 which is slightly larger than the rule die blade 17.

Figure 4:
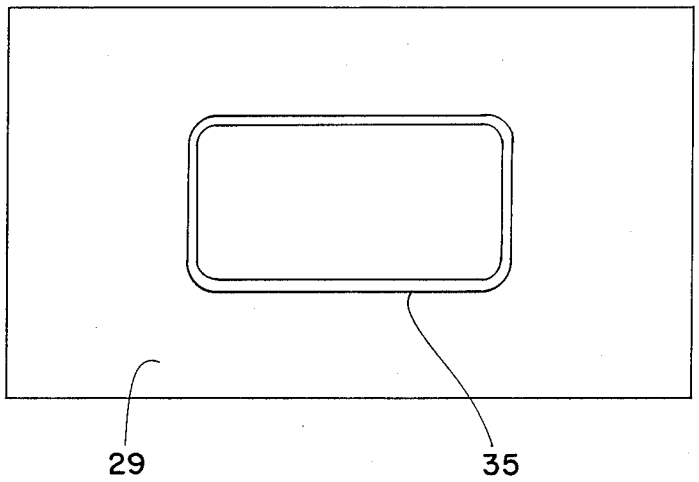
FIG. 4 is a front view of the platen.

The platen 15 consists of a support plate 29, which is attached to a support system 31 by a plurality of support members 33. The support plate 29 has a slot or gap 35. As can be seen in FIG. 4, the slot 35 is the same shape and approximately the same size as the rule die blade 17. The support members 33 are spaced apart to leave gaps 37, so that cuttings can be removed from the platen 15. The support system 31 is connected to a power means for moving the platen 15 toward and away from the die holder 13. The power means may be a hydraulic cylinder or other well known power means.

In operation the sheet of material 11 is placed between the die holder 13 and the platen 15, as shown in FIG. 1. The sheet of material 11 may be a soft plastic material, such as plastic foams of polystyrene, polyethelyne, polypropelyne, or urethane.

Figure 2:
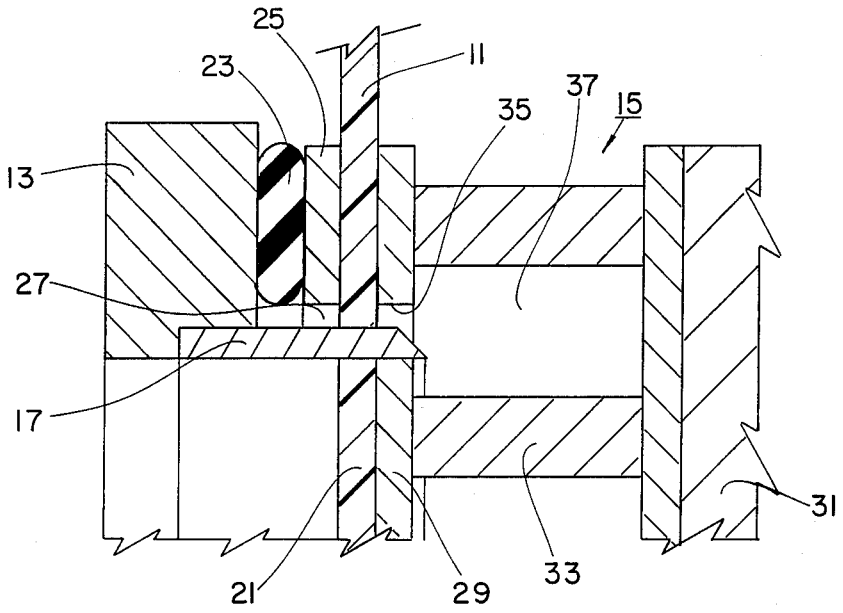
FIG. 2 is a cross-sectional view of a portion of the die cutter, during the cutting operation.

The support system 31 moves the platen 15 toward the die holder 13 until the plate 15 is in the position shown in FIG. 2. At this point, the rule die 17 has penetrated through the plastic material 11 and entered the gap 35 in the support plate 29. The cut product 21 is caught within the rule die 17. The scrap or skeleton of the material 11 is caught between the support plate 29 and the metal face 25. The metal face 25 is pressed against the die holder 13 to compress the spring 23.

Figure 3:
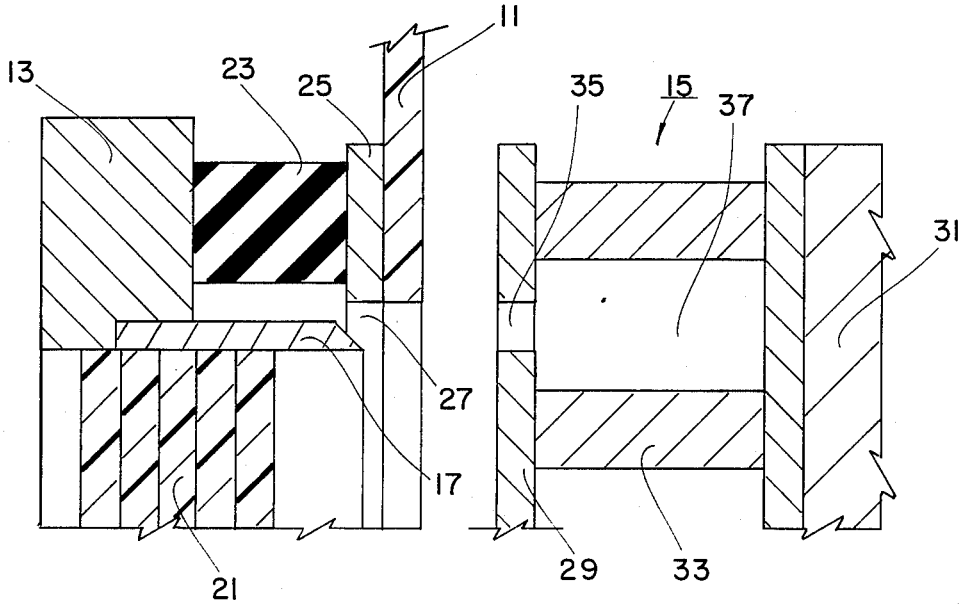
FIG. 3 is a cross-sectional view of part of the die cutter after the cutting operation.

The support system 31 then moves away from the die holder to the position shown in FIG. 3. The cut product 21 remains within the rule die 17. The spring 23 decompresses to push the metal face 25 away from the die holder 13. The metal face 25 pushes the skeleton of the sheet material 11 away from the rule die 17.

The die cutter of the invention has several advantages over the rpior art. The cut product is removed from the skeleton of the sheet material automatically. The cut product passes through the opening in the die holder, as the rest of the sheet material is removed from between the die holder and the platen.

Another advantage comes from the fact that the rule die blade 17 passes through a slot 35, rather than working against a surface. This results in a cleaner cut and longer life for the blade 17. Also, the gaps 37 in the support system 31 allow chaff to fall away from the cutting area.

The invention has been shown in only one of its forms. It should be apparent to those skilled in the art that it is not so limited, but is susceptible to various changes and modifications without departing from the spirit thereof.

I claim:

1. A method for cutting a product from a sheet of plastic foam material, comprising in combination:

(a) providing a rule die blade with an inner perimeter that defines an outline of the product;

(b) mounting the die blade to a die holder which has an opening with a perimeter bounded by the die blade;

(c) mounting a platen in front of and to a support base by at least one support member to define a clearance between the platen and the support base, providing the platen with a central portion bounded by a groove with an inner perimeter having substantially the same dimensions as the inner perimeter of the die blade and which extends completely through the platen in communication with the clearance, and freeing the clearance between the support base and the groove of any obstructions;

(d) mounting a resilient stripper plate on the die holder adjacent to the die blade;

(e) placing a single sheet of plastic foam material between the die blade and the platen;

(f) moving one of the die holder and the platen toward the other until the die blade passes through the sheet and into the groove to cut a completed product from the sheet, causing the completed product to move into the opening bounded by the die blade and causing chaff resulting from cutting of the sheet to pass through the groove and fall freely into the clearance between the platen and support base; then (g) separating the die holder and the platen from each other and stripping with the stripper plate a skeleton scrap of the sheet from the die blade; then (h) removing the skeleton scrap from between the die holder and platen, and repeating steps (e) through (g) continuously to cause the completed products to advance through the opening in the die holder.

2. A method for cutting a product from a sheet of plastic foam material, comprising in combination:

(a) providing a rule die blade with an inner perimeter that defines an outline of the product;

(b) mounting the die blade to a die holder which has an opening therethrough with a perimeter bounded by the die blade;

(c) providing a platen with a central portion bounded by a groove which has an inner perimeter with a shape and size substantially the same as the inner perimeter of the die blade and which extends completely through the platen, and mounting the platen in front of and to a support base by a plurality of spaced apart support members to define a clearance between the platen and the support base which is free of any obstructions between the groove and the support base;

(d) mounting a resilient stripper plate on the die holder adjacent to the die blade;

(e) placing a single sheet of the plastic foam material between the die blade and the platen;

(f) moving one of the die holder the the platen toward the other until the die blade passes through the sheet and into the groove without contacting the platen to cut a completed product from the sheet, causing the completed product to move into the opening bounded by the die blade and causing chaff resulting from cutting of the sheet to pass through the groove and fall freely into the clearance between the platen and support base; then (g) separating the die holder and the platen from each other and stripping with the stripper plate a skeleton scrap of the sheet from the die blade; then (h) removing the skeleton scrap from between the die holder and platen, and repeating steps (e) through (g) continuously to cause the completed products to advance through the opening in the die holder.

3. A method for cutting a product from a sheet of plastic foam material, comprising in combination:

(a) providing a rule die blade with an inner perimeter that defines an outline of the product;

(b) mounting the die blade to a die holder which has an opening therethrough with a perimeter bounded by the die blade;

(c) providing a platen with a central portion bounded by a groove which has an inner perimeter with a shape and size substantially the same as the inner perimeter of the die blade and which extends completely through the platen, defining an outer portion surrounding the central portion, mounting the platen in front of and to a support base by a plurality of support members located between the central portion of the platen and the support base and between the outer portion of the platen and the support base, and spacing the support members apart from each other to define clearances between them and a clearance between the outer and central portions of the platen and the support base which is free of any obstructions between the groove and the support base;

(d) mounting a resilient stripper plate on the die holder adjacent to the die blade;

(e) placing a single sheet of the plastic foam material between the die blade and the platen;

(f) moving one of the die holder and the platen toward the other until the die blade passes through the sheet and into the groove without contacting the platen to cut a complete product from the sheet, causing the completed product to move into the opening bounded by the die blade and causing chaff resulting from cutting of the sheet to pass through the groove and fall freely into the clearances between the platen and support base; then (g) separating the die holder and the platen from each other and stripping with the stripper plate a skeleton scrap of the sheet from the die blade; then (h) removing the skeleton scrap from between the die holder and platen, and repeating steps (e) through (g) continuously to cause the completed products to advance through the opening in the die holder.

* * * * *